US011731799B2

(12) United States Patent
Riethmueller

(10) Patent No.: US 11,731,799 B2
(45) Date of Patent: Aug. 22, 2023

(54) SLEEVE-SHAPED OUTER PART, COMBINATION PACKAGING CONTAINER EQUIPPED THEREWITH, AND METHOD FOR SEPARATING THE COMBINATION PACKAGING CONTAINER

(71) Applicant: greiner packaging ag, Diepoldsau (CH)

(72) Inventor: Steffen Riethmueller, Widnau (CH)

(73) Assignee: greiner packaging ag, Diepoldsau (CH)

( * ) Notice: Subject to any disclaimer, the term of this patent is extended or adjusted under 35 U.S.C. 154(b) by 128 days.

(21) Appl. No.: 17/614,631

(22) PCT Filed: Jun. 3, 2020

(86) PCT No.: PCT/EP2020/065278
§ 371 (c)(1),
(2) Date: Nov. 29, 2021

(87) PCT Pub. No.: WO2020/245148
PCT Pub. Date: Dec. 10, 2020

(65) Prior Publication Data

US 2022/0227524 A1 Jul. 21, 2022

(30) Foreign Application Priority Data

Jun. 7, 2019 (AT) ..... A 50520/2019

(51) Int. Cl.
*B65D 3/26* (2006.01)
*B65D 3/06* (2006.01)
*B65D 25/36* (2006.01)

(52) U.S. Cl.
CPC ..... *B65D 3/264* (2013.01); *B65D 3/06* (2013.01); *B65D 25/36* (2013.01); *B65D 2565/384* (2013.01)

(58) Field of Classification Search
CPC ... B65D 3/06; B65D 3/22; B65D 3/26; B65D 3/261; B65D 3/264; B65D 3/265;
(Continued)

(56) References Cited

U.S. PATENT DOCUMENTS 3,827,620 A * 8/1974 Ludder ..... B65D 3/06 40/306
5,007,578 A * 4/1991 Simone ..... B65D 3/28 206/459.5
5,025,981 A * 6/1991 Schellenberg ..... B65D 25/36 229/118

FOREIGN PATENT DOCUMENTS

CH 706124 B1 * 8/2013 ..... B65D 1/265
DE 29714534 U1 12/1998
(Continued)

OTHER PUBLICATIONS

International Search Report in PCT/EP2020/065278, dated Sep. 10, 2020.

*Primary Examiner* — Nathan J Newhouse
*Assistant Examiner* — Phillip D Schmidt
(74) *Attorney, Agent, or Firm* — Collard & Roe, P.C.

(57) ABSTRACT

A sleeve-shaped outer part is formed from a blank cut that is wound to a sleeve and end sections are connected to one another in an overlap region. A predetermined separating region includes an actuator with a gripping section for the separation of separating sections located on both sides. The separating section, as seen in circumferential direction, is arranged so as to be laterally spaced apart by an offset with respect to the separating sections aligned to taper towards one another and an imaginary straight connecting line between them. A separate predetermined separating section is formed in the sleeve of the outer part between each gripping section end and the respective end of the separating sections. A combination packaging container includes a
(Continued)

Figure 1:
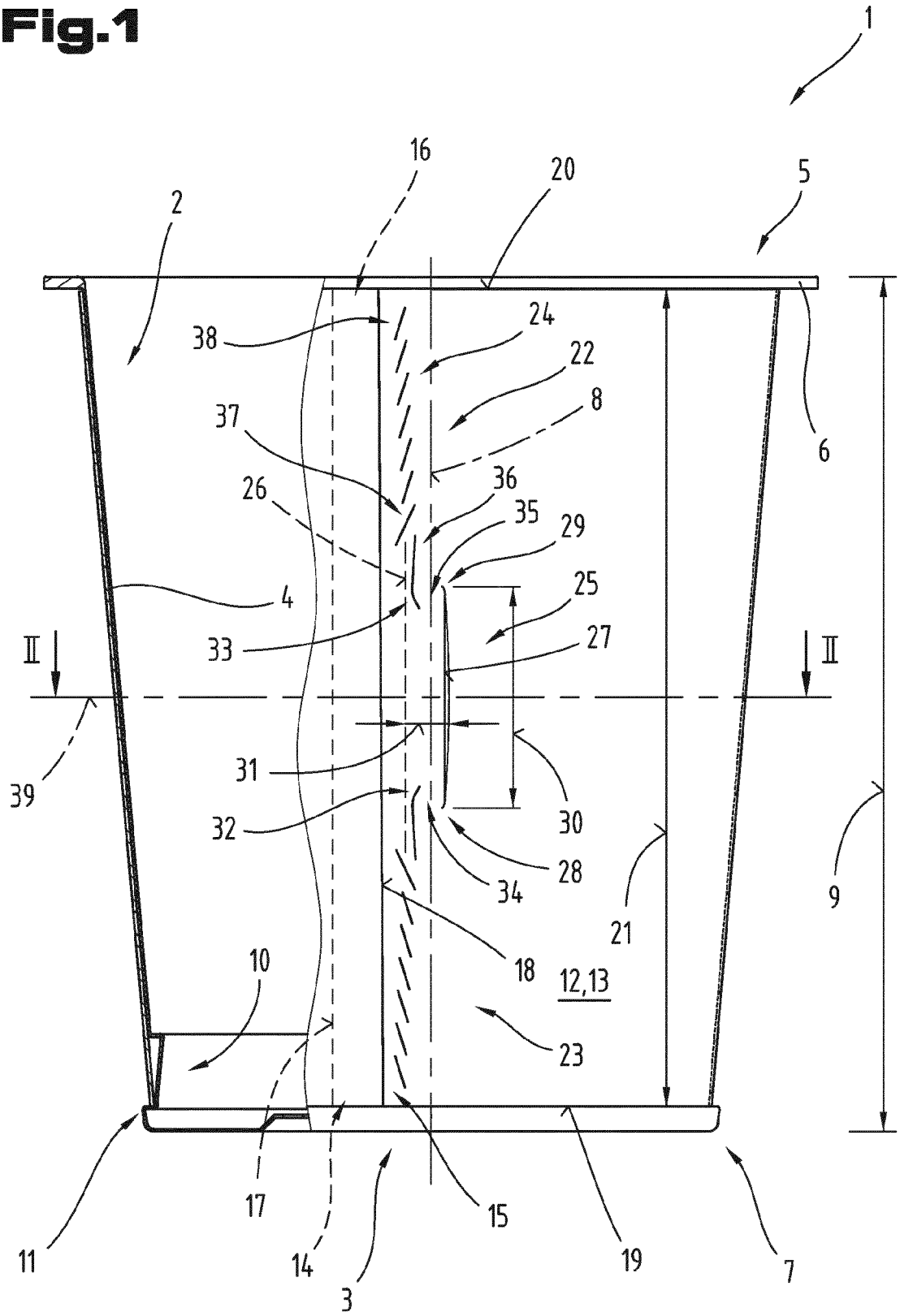

cup-shaped inner container having such an outer part and a method separates the predetermined separating region and the separation of the outer part from the inner container.

25 Claims, 7 Drawing Sheets

(58) Field of Classification Search
CPC ..... B65D 3/266; B65D 3/267; B65D 3/28; B65D 2565/385; B65D 1/265
USPC ..... 229/200–203, 240–241, 903, 925; 206/831
See application file for complete search history.

(56) References Cited

FOREIGN PATENT DOCUMENTS

| | | | | | |
|---|---|---|---|---|---|
| DE | 10 2011 014 844 | A1 | | 9/2012 | |
| EP | 408515 | A | * | 1/1991 | ..... B65D 1/26 |
| EP | 2338804 | A1 | * | 6/2011 | ..... B65D 1/26 |
| EP | 2 338 804 | B1 | | 6/2013 | |
| GB | 2486105 | B | | 10/2012 | |
| JP | 2009-126536 | A | | 6/2009 | |
| WO | 2009/130043 | A1 | | 10/2009 | |
| WO | WO-2009130043 | A1 | * | 10/2009 | ..... B65D 1/265 |

* cited by examiner

SLEEVE-SHAPED OUTER PART, COMBINATION PACKAGING CONTAINER EQUIPPED THEREWITH, AND METHOD FOR SEPARATING THE COMBINATION PACKAGING CONTAINER

CROSS REFERENCE TO RELATED APPLICATIONS

This application is the National Stage of PCT/EP2020/065278 filed on Jun. 3, 2020, which claims priority under 35 U.S.C. § 119 of Austrian Application No. A50520/2019 filed on Jun. 7, 2019, the disclosure of which is incorporated by reference. The international application under PCT article 21(2) was not published in English.

The invention relates to a sleeve-shaped outer part formed from a blank cut for encasing a cup-shaped inner container, as well as to a combination packaging container formed from the inner container and the outer part. However, the invention also relates to a method for splitting the combination packaging container into its inner container and the outer part by separating the predetermined separating region.

WO 2009/130043 A1 inter alia describes an exterior part shaped as a casing for forming a combination packaging container. The exterior part is formed from a blank cut by raising and mutually joining ends in an overlap region. Furthermore, an actuating means for separating a predetermined separating region is provided, which is arranged between the two end regions spaced apart from each other in the axial direction. The actuating means is once formed by an opening extending to the overlap region, wherein the longitudinal side of the overlapping end forms the gripping section. In a further exemplar embodiment, an actuating tab is provided which can be detached from the casing in a U-shaped circumferential line, in which the weakening line surrounding the actuating tab ends at the longitudinal side of the overlapping end. This embodiment has proven itself in principle, but it has not been possible to achieve perfect separation of the predetermined separating region abutting on the actuating means in all applications.

A packaging container having a first container part comprising a container base and a container wall extending from the container base in the direction of a container edge, and a second container part reinforcing the container wall in the form of a sleeve detachably connected to the first container part and at least partially abutting the outer surface of the container wall, is known from EP 2 338 804 B1.

The second container part has a weakening line extending from an upper edge of the second container part facing the container edge towards a lower edge of the second container part facing the container bottom. The second container part is detachable from the first container part by separating the second container part along the weakening line. The second container part further comprises a grasping region to be manually grasped for separating the second container part, from which the second container part is detachable from the first container part. The weakening line has a grasping section bounding the grasping region with a reinforced weakening and/or a cut line, which forms the starting section for separating the second container part along the weakening line. Furthermore, an access region adjacent to the grasping region and located on the side of the weakening line opposite to the grasping region is provided, which access region has two predetermined separating lines extending transversely to the weakening line and terminating on one side in the grasping section of the weakening line. This ensures that the access region remains firmly connected to that edge region of the second container part which does not have the grasping region, after separation along the predetermined separating lines and the grasping section. Here, too, it has not been possible to achieve perfect separation of the predetermined separating region adjoining the grasping region in all applications.

It was the object of the present invention to overcome the shortcomings of the prior art and to provide a sleeve-shaped outer part as well as a combination packaging container comprising a cup-shaped inner container having a sleeve-shaped outer part surrounding it, by means of which a user is able to perform a safe and above all continuous separation of the predetermined separating region. Moreover, a method for separating the predetermined separating region and the subsequent splitting of its outer part and inner container is to be created.

This object is achieved by a sleeve-shaped outer part as well as a combination packaging container comprising a cup-shaped inner container and a thus designed sleeve-shaped outer part according to the claims.

The sleeve-shaped outer part according to the invention serves for encasing a cup-shaped inner container to form a combination packaging container,

- wherein the inner container comprises a container sleeve, which is formed, in particular so as to conically taper, from an open end to a base forming a closed end,
- wherein the outer part is formed from a blank cut, said blank cut is wound into a sleeve in its upright state, and, in this respect, a first end section and a second end section of the sleeve facing the first end section are connected to each other in an overlap region,
- wherein the outer part moreover has a first front side and a second front side and the two front sides are spaced apart from one another and in the upright state define a constructional height of the sleeve, and, in this regard, the first front side may be made to face the base and the second front side may be made to face the open end of the inner container,
- wherein at least one predetermined separating region formed in the sleeve of the outer part is provided, said predetermined separating region comprising a first separating section and a second separating section each having multiple predetermined separating points, in particular perforations or cuts, arranged behind one another, as well as an actuating means located between the two front sides in the direction of the constructional height for separating the predetermined separating region along the two separating sections located on both sides of the actuating means,
- wherein the two separating sections of the predetermined separating region are aligned to taper towards one another as seen in the direction of the constructional height of the sleeve,
- wherein the actuating means defines a gripping section having a first gripping section end and a second gripping section end,
- wherein the two gripping section ends are arranged at a distance from one another as seen in the direction of the constructional height of the sleeve, and
- wherein the gripping section of the actuating means is arranged or formed outside the overlap region, and wherein it is further provided
- that the gripping section of the actuating means, as seen in circumferential direction, is arranged or formed so as to be laterally spaced apart by an offset with respect to the separating sections aligned to taper towards one another of the predetermined separating region and an imaginary straight connecting line between them, that the first gripping section end of the gripping section overlaps an adjacent first end of the first separating section onto the side facing away from the second separating section, that a first predetermined separating section in the sleeve of the outer part, as seen in the circumferential direction of the sleeve, is formed between the first gripping section end and the first end of the first separating section, that the second gripping section end of the gripping section overlaps an adjacent second end of the second separating section onto the side facing away from the first separating section, that a second predetermined separating section in the sleeve of the outer part, as seen in the circumferential direction of the sleeve, is formed between the second gripping section end and the second end of the second separating section, and that the two predetermined separating sections each form a starting section for the separation of the two separating sections of the predetermined separating region upon actuation of the actuating means.

The thus achieved advantage is that by the lateral offset of the gripping section extending in circumferential direction of the sleeve with respect to the separating sections aligned to taper towards one another and located for the most part on both sides and the additional ends overlapping each other in the axial direction on both sides of the actuating means, in each case, a separate predetermined separating section in the sleeve of the outer part is created. Hence, the separate predetermined separating section is formed in the sleeve and thus in the material of the outer part between the respective gripping section end and the respective end of the separating section, wherein upon actuation and gripping of the gripping section, a tearing force acting approximately in the tangential direction with respect to the longitudinal axis and/or in the circumferential direction is applied to each one of the predetermined separating sections.

This actuating force applied at least in the tangential direction and optionally additionally in the radial direction, effects the separation of the two predetermined separating sections, wherein starting from these, a targeted further separation of the separating section in each case located on both sides of the gripping section along their predetermined separating points in the direction towards the two front sides of the sleeve. Thus, ensures a targeted deflection of the tearing process starting from the respective predetermined separating section towards the two separating sections extending in the direction of the constructional height. Moreover, hence, gripping under the gripping section on the side of the outer part facing the inner container is facilitated since by the tearing direction of the two predetermined separating sections extending essentially in the circumferential direction, the actuating means with its gripping section may be torn further from the inner container in the radial direction. The further tearing process and thus the separation of the two separating sections is then successively performed starting from the respective end facing the gripping section towards the two front sides of the outer part distanced from one another in the axial direction and/or the constructional height.

Moreover, it may be advantageous for the gripping section of the actuating means to be formed by a cutting line completely passing through the sleeve. This spares the user an additional separating process in the region of the sleeve and they can directly grip the gripping section in the region of the cutting line and start the separating process for the subsequent separate disposal of the inner container and the outer part.

Another embodiment is characterized in that the cutting line has a straight longitudinal extension. Thus, it is made possible for the user to grip the gripping section at any chosen position so as to be able to initiate the tearing start.

A further possible embodiment has the features that the cutting line has a curved longitudinal extension, in particular an arcuately curved longitudinal extension. Hence, depending on the extension of the curvature, namely convexly or concavely, grasping of the gripping section may be designed more individually.

In a further embodiment, it is provided that the actuating means comprises an opening completely passing through the sleeve, said opening being arranged on the side of the gripping section facing away from the overlap region and so as to directly adjoin the gripping section. Thus, by the provision of an additional opening adjoining the gripping section, the actuating means may be designed even more visibly and easier to optically recognize.

Another embodiment is characterized in that the actuating means is arranged approximately centrally between the two front sides spaced apart from one another in the direction of the constructional height. By the central arrangement, hence, a central impact point in the direction of the overall constructional height and/or longitudinal extension may be provided. Thus, an even more uniform separation of the outer part into both directions may be achieved.

A further preferred embodiment is characterized in that first predetermined separating points of the two separating sections, which are each arranged directly adjacent to the two gripping section ends of the gripping section, in each case have a first longitudinal extension extending in parallel direction with respect to the imaginary connecting line between the two separating sections on their side facing away from the gripping section and in each case have a second longitudinal extension aligned in the direction towards the gripping section on their side facing the gripping section. By the particularly designed longitudinal extension of the first predetermined separating points, thus, an even more targeted separation of the predetermined separating section between the respective ends of the separating sections may be achieved. Hence, by the second longitudinal extension of the first predetermined separating point, which is in each case aligned towards the gripping section, an even more targeted and even better defined tearing direction is created.

Moreover, it may be advantageous for the second longitudinal extension to be designed so as to be arcuately curved and/or extends so as to be aligned at an angle with respect to the first longitudinal extension. Thus, an even better targeted deflection of the tearing process from the respective predetermined separating section towards the two separating sections is achieved.

Another alternative embodiment is characterized in that second predetermined separating points and/or third predetermined separating points of the two separating sections, which are in each case arranged so as to adjoin the first predetermined separating points as well as on the side facing away from the actuating means, have an alignment extending at an angle with respect to the imaginary connecting line. By the further predetermined separating points aligned at an angle, thus, the separating process between directly adjacent predetermined separating points may be facilitated and improved.

A further possible and optionally alternative embodiment has the features that the angularly extending alignment of the second predetermined separating points and/or third predetermined separating points of the first separating section and the second separating section is selected such that these are in each case aligned to taper towards one another towards the side facing away from the actuating means. Hence, by the alignment in each case tapering towards one another and being angled of the further predetermined separating points of predetermined separating points of the two separating sections corresponding in each case, the separating behavior in the region of the predetermined separating section may be made even safer.

In a further embodiment, it is provided that an angle enclosed by the second predetermined separating points of the first and the second separating sections or an angle enclosed by the third predetermined separating points of the first and the second separating sections, is formed differently with respect to one another starting out from the actuating means towards the respective front sides. By the enclosed angles selected so as to be different with respect to one another, the tearing behavior may be significantly improved also during the progressing separation process between directly adjacent predetermined separating points.

Another embodiment is characterized in that the enclosed angle is designed to be increasing and thus larger starting from the actuating means towards the respective front sides. By the changing and enlarging enclosed angle, an approximately constant separating force is defined across the entire opening path.

Another preferred embodiment is characterized in that the predetermined separating region is arranged or formed in the first end section and the first end section is located on the inside and is outwardly overlapped by the second end section in the overlap region. Thus, the predetermined separating region may be arranged so as to extend directly adjacent to the overlapping longitudinal edge of the second, outwardly located end section. Hence, by covering the second end region, an even more safe separation of the predetermined separating region may be achieved due to the more stable overlap region.

Moreover, it may be advantageous if the predetermined separating region is arranged so as to extend in parallel direction with respect to the longitudinal edge of the overlapping outward second end region. Thus, the predetermined separating region may be arranged directly adjacent to the longitudinal edge of the overlapping, outward second end section. Thus, furthermore, a protective effect may be achieved for the predetermined separating region and, moreover, an unintended separation may be largely prevented.

Another embodiment is characterized in that the predetermined separating region is arranged or formed in the first end section and the first end section is arranged outwardly in the overlap region and the second end section is arranged inwardly and is outwardly overlapped by the first end section. By the outward arrangement of the predetermined separating region in the overlap region, grasping and gripping of the gripping section of the actuating means may be facilitated by the small distancing from the container wall.

A further possible embodiment has the features that the predetermined separating region is arranged to extend in parallel direction with respect to a longitudinal edge of the overlapped inward second end section. Thus, the covered longitudinal edge located below may serve as a support and stiffening for the separating process of the predetermined separating region.

In a further embodiment, it is provided that the predetermined separating region is arranged or formed outside the overlap region. Thus, depending on the overlap arrangement of the end section facing one another, a safe tearing process may always be ensured. Another embodiment is characterized in that the blank cut is formed from a cellulose material. Thus, on the one hand, printing and optical design of the inner container enclosed with the sleeve-shaped outer part may be improved and, moreover, the accumulation of plastic material to be disposed of may be reduced.

A further preferred embodiment is characterized in that the cellulose material is formed from a recycling material. Thus, raw material resources may be saved. Moreover, hence, in conjunction with the predetermined separating sections adjoining the gripping section and the two separating sections adjoining it, a safe and continuous separating process of the predetermined separating region may be made possible even when cellulose recycling materials are used. Otherwise, the continuous separation process is not possible completely and flawlessly when using recycled materials due to the shorter fiber lengths.

The invention also relates to a combination packaging container comprising a cup-shaped inner container having a container sleeve, a base, a flange as well as a sleeve-shaped outer part surrounding the inner container at its container sleeve at least in some sections designed according to the invention.

Thus, the combination packaging container is created which may be separated into the inner container and the outer part after use even more easily and above all more safely. After the separation process of the predetermined separation region, the outer part forms a coherent piece which may be easily and, above all, in one piece, be provided to proper disposal and collection of recyclable materials.

A further possible embodiment of the combination packaging container has the features that the outer part comprises, at its end section facing the flange, a folded edge folded inwards in the direction of the container sleeve, and the inner container has an inwardly offset wall section, said wall section being arranged or formed directly adjacent to the flange in the container sleeve and defining a receiving space, in which receiving space the folded edge is received, and that the inner container has a shoulder on the base side, on which shoulder the outer part is supported. Hence, in addition to the mechanical support effect on the base side, a form-fitting retainer may also be created between the folded edge of the outer part and the receiving space which is offset inwards in the direction of the longitudinal axis. However, the object of the invention is also achieved by a method for separating an outer part equipped with the predetermined separating region formed according to the invention from an inner container, which together form the combination packaging container, in that during the separation process of the predetermined separating region a procedure is followed according to which a pressure force -F- directed towards the combination packaging container is applied and, in the course of this, at least the container sleeve of the combination packaging container is spatially deformed and, by the spatial deformation, the applied pressure force -F- is at least partially converted into a separating force which at least partially separates the predetermined separating region.

The applied pressure force -F- results at least in a spatial deformation of the container sleeve, whereby the pressure force is at least partially transmitted from the inner container to the outer part and/or deflected thereon. Thus, a separation force acting in the radial direction and/or in the circumferential direction is applied to the predetermined separating region depending on the alignment of the pressure force and the separation process of the predetermined separating region is performed by the separation force at least partially, however, preferably continuously across the entire height and/or length of the outer part in the direction of the predetermined separating region. For the person supposed to carry out the separation process, searching and finding the actuating means for the predetermined separating region and the following tearing process may be dispensed with.

Moreover, an approach is advantageous according to which the combination packaging container is placed on a support surface either with its closed end or with its open end of the inner container and subsequently the pressure force -F- is applied to the end facing away from the support surface in the direction towards the support surface. Depending on the arrangement and placement of the combination packaging container, hence, the pressure force may be applied to the combination packaging container and introduced into it, for example with human force. The risk of injury may be minimized in the arrangement in which the pressure force is applied to the base.

A further advantageous approach is characterized in that the pressure force -F- is applied to the combination packaging container in a parallel alignment with respect to a longitudinal axis extending between the open end and the closed end or in an angled alignment with respect to the longitudinal axis. Thus, with a parallel force application, the pressure force can simply be deflected into a tearing force acting in a predominantly radial direction, at least to a large extent, which leads to the outer part bursting open along the predetermined separating region. In case of the direction of force application deviating from this, the spatial reshaping may also cause the predetermined separating region to separate.

A method variant in which the pressure force -F- is applied to the combination packaging container by means of a pressing device is also advantageous. With this approach, the user of the composite packaging container can be spared the separation process and the associated detachment of the outer part from the inner container.

For the purpose of better understanding of the invention, it will be elucidated in more detail by means of the figures below.

Figure 2:
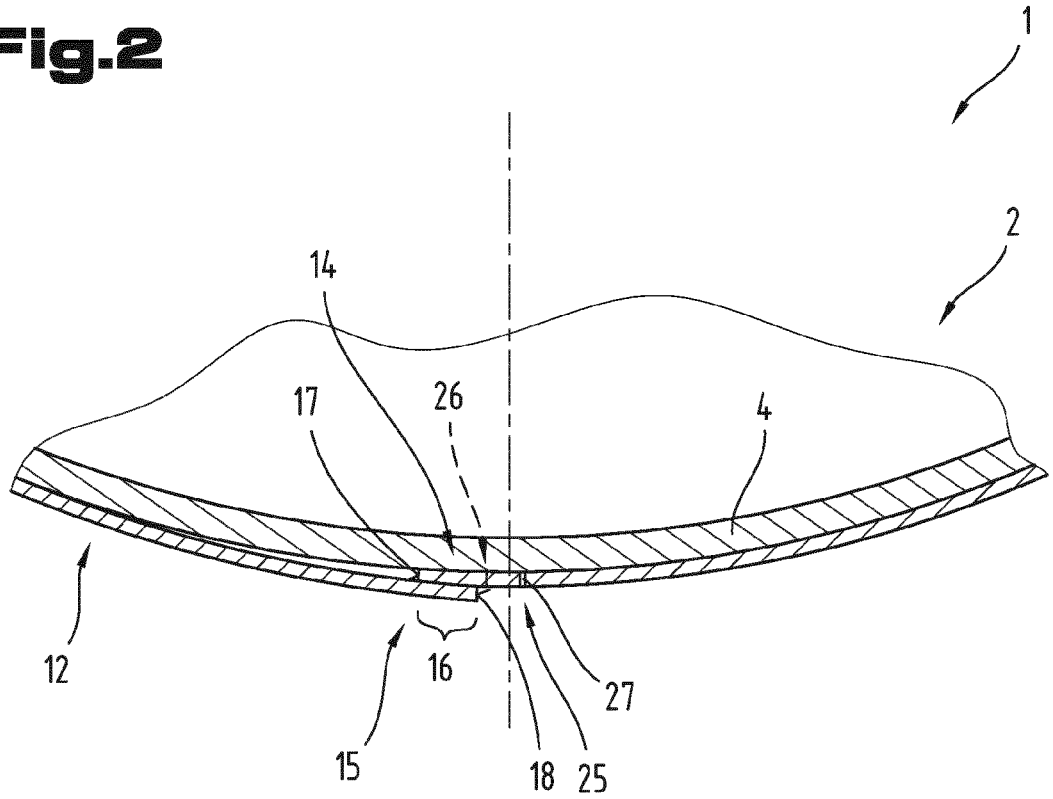
Figure 3:
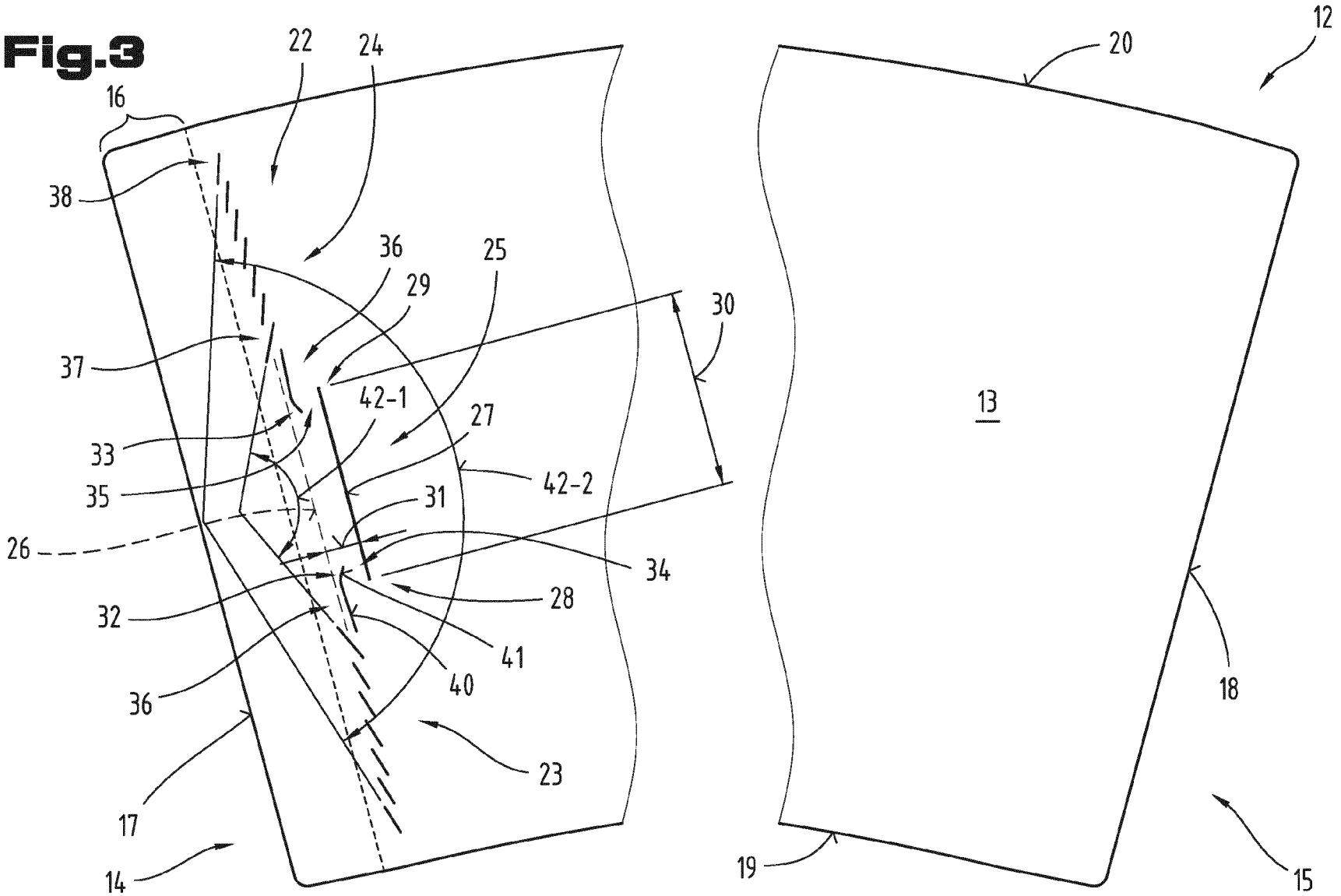
Figure 4:
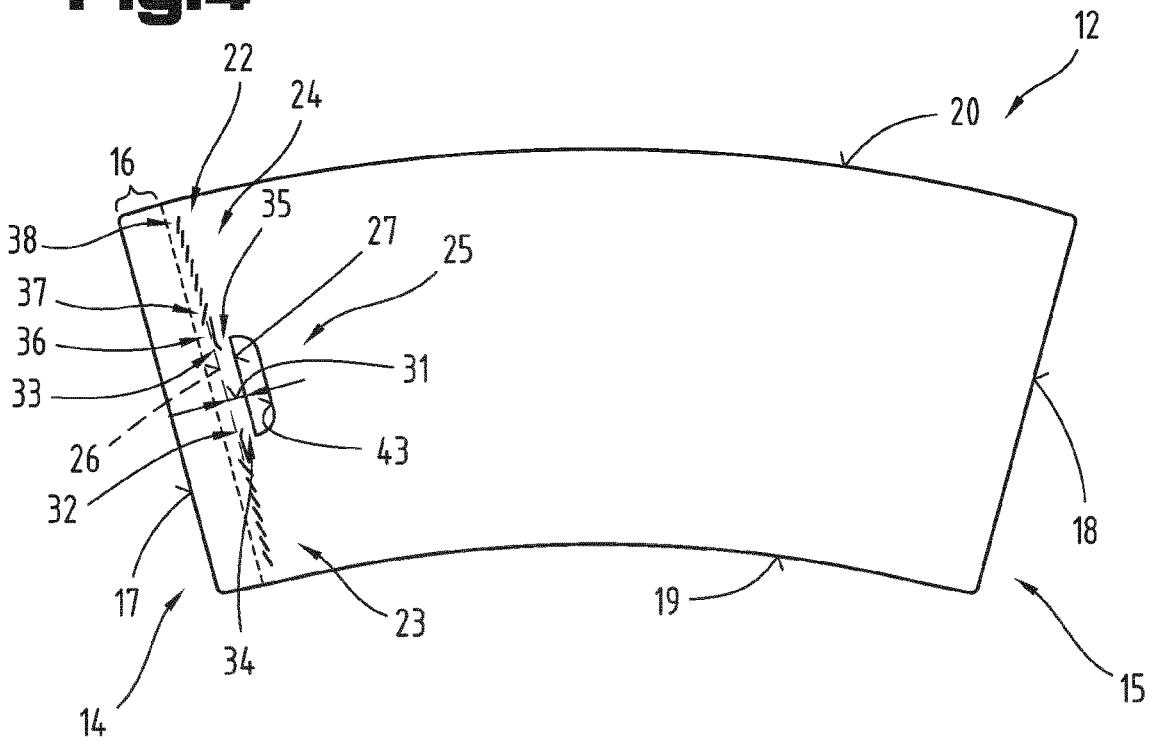
Figure 5:
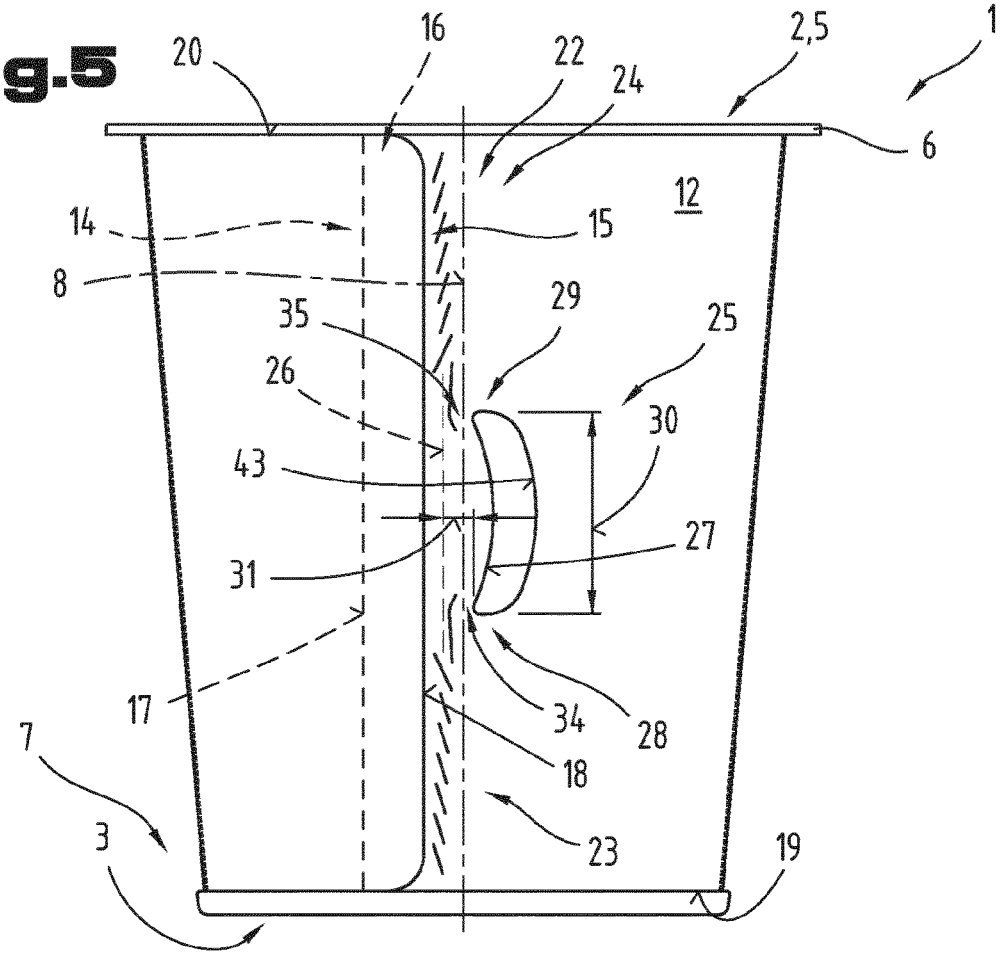
Figure 6:
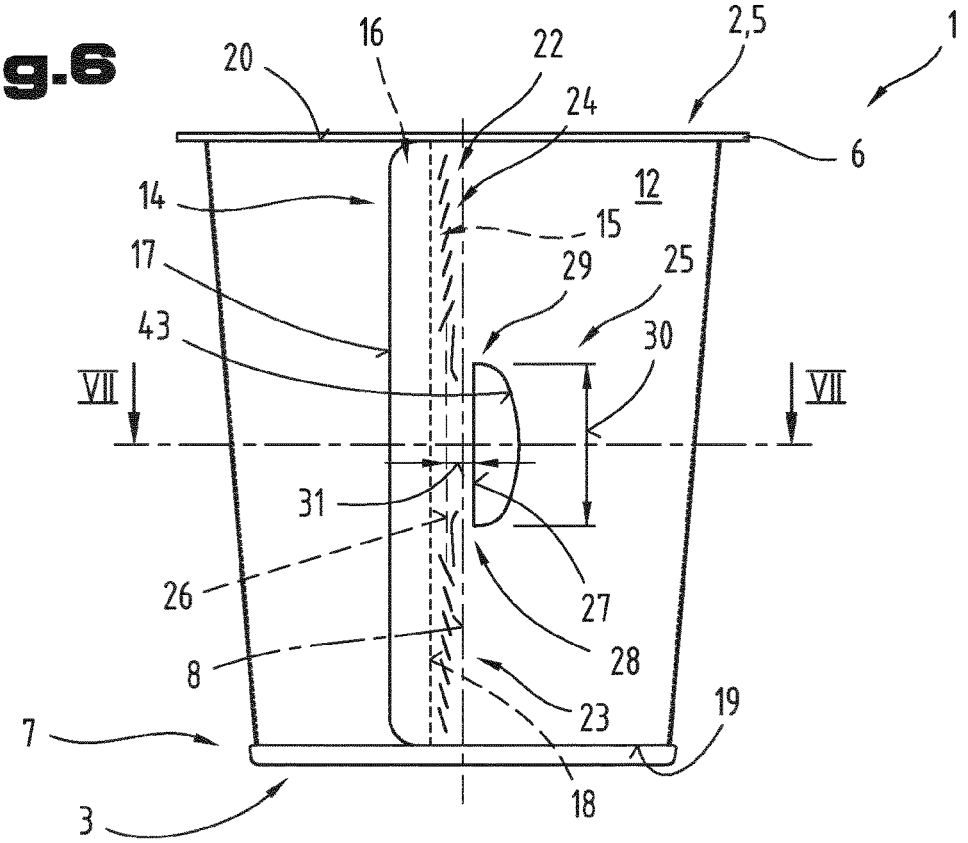
Figure 7:
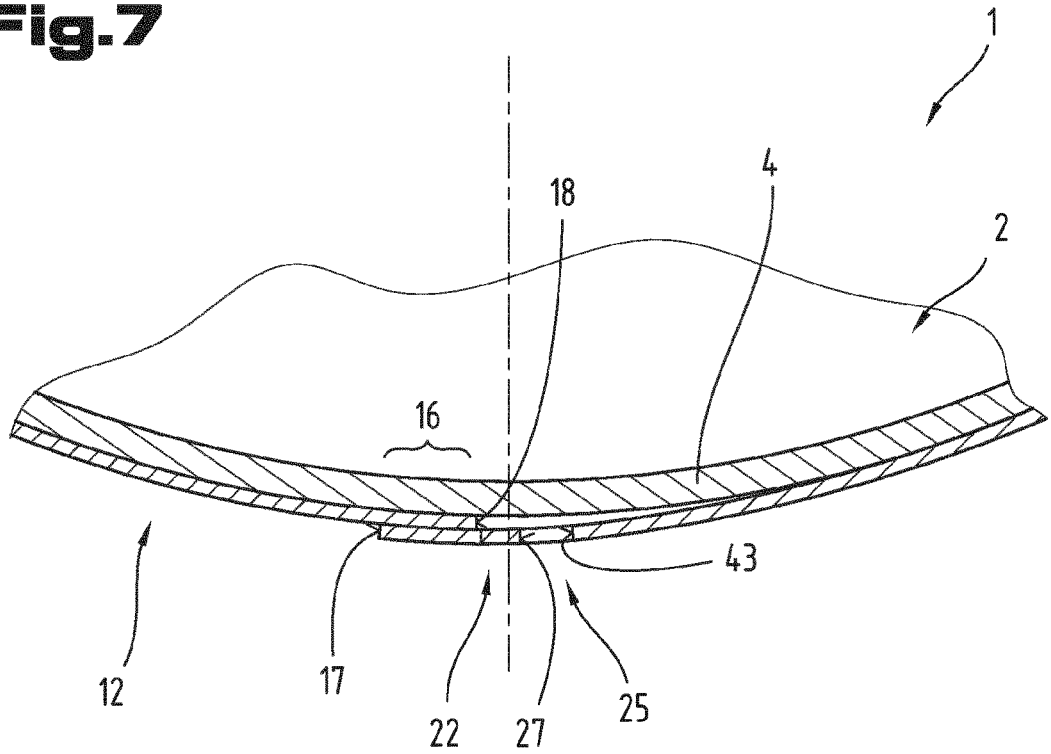
Figure 8:
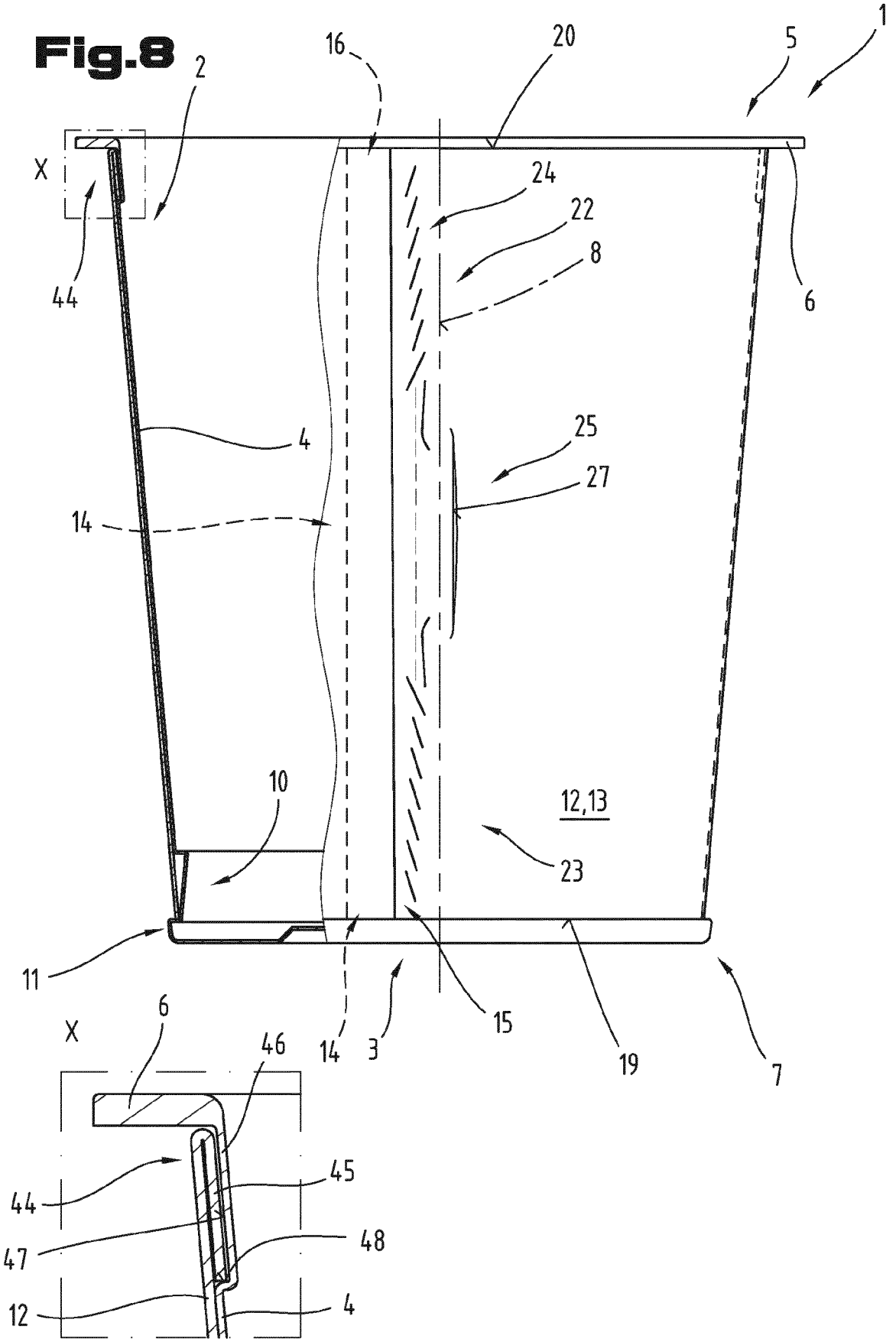
Figure 9:
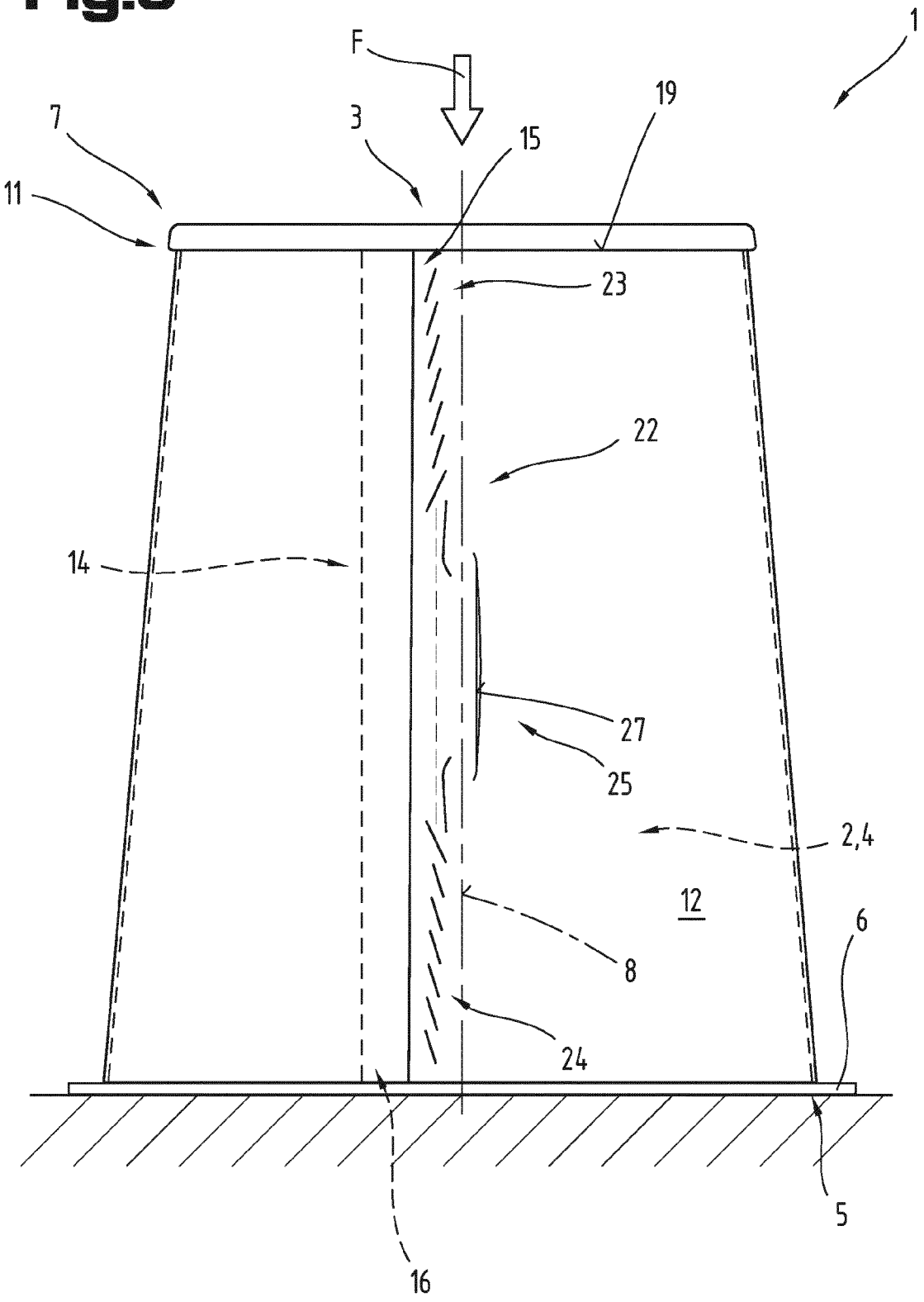

These show in a respectively very simplified schematic representation:

FIG. 1 a view of a combination packaging container having an inner container and an outer part, partially in section;

FIG. 2 the combination packaging container in section according to lines II-II in FIG. 1 in the region of its actuating means, in an enlarged view;

FIG. 3 a blank cut for forming the outer part, in undeformed, plane position;

FIG. 4 a further possible embodiment of the blank cut for forming the outer part, in undeformed, plane position, with a modified design of the predetermined separating region;

FIG. 5 a view of a combination packaging container with an inner container and an outer part and a further, possible embodiment of the predetermined separating region;

FIG. 6 a view of a further combination packaging container with an inner container and an outer part and a modified arrangement of the overlapping end sections in the overlap region;

FIG. 7 the combination packaging container according to FIG. 6 in section according to lines VII-VII in FIG. 6 in the region of its actuating means as well as in an enlarged view;

FIG. 8 a view of a further possible exemplary embodiment of the combination packaging container with the inner container and the outer part, partially in section;

FIG. 9 a view of a schematic representation of a possibility for applying the pressure force to the combination packaging container for separating the predetermined separating region.

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

The term "in particular" shall henceforth be understood to mean that it may refer to a possible more specific formation or more detailed specification of an object or a process step, but need not necessarily depict a mandatory, preferred embodiment of same or a mandatory practice.

FIGS. 1 to 3 show a combination packaging container 1 by way of example of a plurality of possible different designs, wherein the combination packaging containers 1 are designed so as to be cup-shaped or bowl-shaped. The combination packaging container 1 comprises a cup-shaped or bowl-shaped inner container 2 having a base 3 and a container sleeve 4. The inner container 2 further comprises an open end 5 on the side facing away from the base 3, wherein a flange 6 projecting outwards over the container sleeve 4 may be provided in the region of its open end 5. The base 3 forms a closed end 7 for the container sleeve 4.

The inner container 2 is preferably formed by a component produced in a deep drawing process, which may be produced quickly and above all in shorter cycle times. The deep drawing process is sufficiently known and is therefore not elucidated in further detail. The deep drawing process is particularly suitable for producing the inner container 2 with a still sufficient wall thickness from a layer to be deformed of a deformable material by means of a deep drawing tool, said wall thickness ensuring the density during storage, use and until disposal. By this production process, relatively thin wall thicknesses of the inner container 2 may be produced.

By the cup-shaped and/or bowl-shaped formation of the inner container 2, a longitudinal axis 8, which may also represent a central axis in a symmetrical design, extends in the axial direction between the open end 5 and the end 7 closed by the base 3. It is possible to arrange a sealing lid, which is not shown in further detail, in the region of the flange 6 and/or to connect it therewith. In this case, the flange 6 forms a sealing flange.

In the axial direction, and thus in the direction of the longitudinal axis 8, the inner container 2 comprises a container height 9 between its open end 5, in particular the flange 6, and the base 3, whereby the receiving volume of the inner container 2 is determined depending on the cross-sectional dimensions. By the container height 9 in conjunction with the cross-sectional dimensions, thus, a receiving space of the inner container 2 is defined.

The section of the inner container 2 which extends in predominantly axial direction between the open end 5, in particular the flange 6, and the base 3 is understood to be the container sleeve 4. Preferably, the inner container 2 with its container sleeve 4 is formed such that it preferably conically tapers starting from the open end towards the base.

Furthermore, the container sleeve 4 of the inner container 2 may comprise an indentation 10 in its circumferential section adjacent to the base 3. The indentation 10 is also part of the container sleeve 4, is, however, arranged so as to be inwardly offset as seen in the axial section with respect to an imaginary, straightly extending connecting line between the flange 6 and the base 3. The indentation 10, in turn, comprises at least two indentation wall section, which are not described in further detail, wherein the two indentation wall section have a different inclination and/or direction than the rest of the container sleeve 4 with respect to the longitudinal axis 8 as seen in axial section. In this regard, the indentation 10 is arranged so as to be offset inwards, and thus into the direction of the receiving space, in relation to the arrangement of the container sleeve 4, extending straightly as seen in axial section, between the flange 6 and the base 3.

As seen in axial section, the first indentation wall section directly adjoining the base 3 is arranged and/or formed so as to extend predominantly in the direction of the contain height 9 towards the open end 5. The further indentation wall section extends in predominantly perpendicular direction with respect to the container height 9, starting from the end of the first indentation wall section facing away from the base 3 towards the container sleeve 4. In the present exemplary embodiment, the further indentation wall section forms a stacking shoulder. The purpose of this stacking shoulder is to allow a combination packaging container 1 of the same type to rest on it with its base 3, in particular the edge transition section between the base 3 and the container sleeve 4.

Furthermore, the inner container 2 may comprise a shoulder 11 projecting to the side facing away from the longitudinal axis 8 and/or a bead in the direct transition region between the base 3 and the container sleeve 4, in particular between the base 3 and the indentation.

The combination packaging container 1 further comprises an outer part 12 which is designed so as to be sleeve-shaped or sleeve-shaped and surrounds the inner container 2 in the region of its container sleeve 4 at least in some sections or in some regions.

The shoulder 11 described above may for example serve for holding the sleeve-shaped outer part 12 on the inner container 2 in a latched manner In this case, the sleeve-shaped outer part 12 is supported with its first front side 19 facing the base 3 of the inner container 2 on this shoulder 11 formed in the transition region. Thus, the shoulder 11 may also be referred to as a latching means for holding the outer part 12 on the inner container 2. The flange 6, for example, may represent a further latching means in the region of the open end 5. Moreover, the sleeve-shaped outer part 12 comprises a second front side 20 which, in turn, faces the open end 5 or the flange 6.

The sleeve-shaped outer part 12 is preferably formed from a cellulose material, such as a cardboard material, with a sufficient solidity regarding the absorption and transmission of particularly axially acting pressure forces and is wound to a sleeve from a planar blank cut 13, as is already sufficiently known. The blank cut 13 is usually printed onto in its undeformed planar position and is optionally provided with an additional coating. Usually, a cellulose material is used as the material; however, the material may also be a cardboard produced in a recycling process or a kraft paper. If a layer and/or ply of the outer part 12 is formed from a recycling material, an additional layer from a higher-quality paper may be arranged on at least one of the surfaces and/or be connected therewith. This additional layer serves for flawless printing for the production of decorations, inscriptions as well as product information.

The sleeve-shaped and/or sleeve-like outer part 12 results in an additional reinforcing and/or stiffening effect of the inner container 2 and thus of the entire combination packaging container 1.

This provides high strength and good thermal insulation on the one hand and optimum light protection for the contents of the packaging container on the other hand.

In particular, it may also be provided that the cardboard is additionally coated or sealed with a water-repellent material in the region of the cut edges. This is particularly advantageous where the combination packaging containers 1 are subjected to an increased exposure to moisture. This is due to the fact that by the coating of the cardboard used for the outer part 12 with a water-repellent layer, it is prevented that maceration of the cardboard and lastly detachment from the container sleeve 4 of the combination packaging container 1 occurs in a humid surrounding.

The sleeve-shaped outer part 12 is wound to form a sleeve from the usually planar blank cut 13. By winding the blank cut, end sections 14, 15 facing one another are connected to one another in an overlap region 16 shown in simplified manner This is performed by a so-called overlap seam by means of which the first end section 14 and the second end section 15 adhere to another, for example by means of an adhesive agent. In this regard, winding and subsequent connecting of the two end sections 14, 15 may be carried out for example by bonding, as is already known sufficiently from the prior art. EP 0 408 515 B1 is indicated and made reference to as an example in this regard. The first end section 14 of the blank cut 13 ends with a first longitudinal edge 17 and the second end section 15, in turn, ends with a second longitudinal edge 18. In the overlap region 16, the two longitudinal edges 17, 18 extend approximately in parallel to one another, wherein, as seen in the circumferential direction, the overlap region 16 is formed between these with an overlap width.

The outer part 12 further comprises the first front side 19 and the second front side 20, wherein the two front sides 19, 20 are spaced apart from one another and define a constructional height 21 of the sleeve in the upright state. The longitudinal axis 8 described above may also define the common longitudinal axis for the outer part 12, in particular once the outer part 12 is located on the inner container 2 in its fitted state. Usually, the constructional height 21 of the sleeve is slightly smaller than the container height 9 of the inner container 2 in the same spatial direction—namely in the direction of the longitudinal axis 8.

To allow a user to perform a defined separation and, associated therewith, a subsequent separate disposal of the inner container 2 and the outer part 12, at least one predetermined separating region 22 formed in the sleeve of the outer part 12 is provided. Here, the predetermined separating region 22 comprises a first separating section 23, a second separating section 24 as well as an actuating means 25 for starting and beginning the separating process of the predetermined separating region 22 along the two separating sections 23, 24. The actuating means 25 is arranged between the two front sides 19, 20 as seen in the direction of the constructional height 21 of the sleeve. In this regard, it is advantageous if the actuating means 25 is arranged approximately centrally between the front sides 19, 20 spaced apart from one another in the direction of the constructional height 21, wherein this essentially corresponds to half the constructional height 21. The specification "centrally" with respect to the actuating means 25 refers to half its dimension in the direction of the constructional height 21 or the longitudinal axis 8. The two separating sections 23, 24 are provided on both sides of the actuating means 25 and each extend in the direction towards the respective front side 19, 20.

As seen in the direction of the constructional height 21 of the sleeve, the two separating sections 23, 24 of the predetermined separating region 22 are in each case aligned to taper towards one another from the two front sides 19, 20 and hence define an imaginary, straightly extending connecting line 26 between them which is shown in dashed lines. The tapering alignment of the two separating sections 23, 24 in each case refers to the direction towards the actuating means 25. The two separating sections 23, 24, as seen in the direction of the constructional height 21 of the sleeve, can either be aligned with one another or can also be slightly inclined with respect to the first longitudinal edge 17 in the direction of the actuating means 25 located between them. This slight inclination may additionally improve the separation process after the separation of the two separating sections 23, 24 towards the two front sides 19, 20.

Depending on the formation of the predetermined separating points, which will be described in further detail below, the imaginary connecting line 26 is assumed to extend in a center of the predetermined separating points. The actuating means 25, in turn, defines a gripping section 27 with a first gripping section end 28 and a second gripping section end 29 located so as to be spaced apart from one another in the direction of the constructional height 21. Thus, the two gripping section ends 28, 29, as seen in the direction of the constructional height 21 of the sleeve, are arranged so as to be distanced from one another at a distance 30 and/or end there. Furthermore, it can be seen that the gripping section 27 of the actuating means 25 is arranged or formed outside the overlap region 16.

Here, an arrangement of the actuating means 25 is provided in which the gripping section 27, as seen in circumferential direction, is arranged or formed so as to be laterally spaced apart by an offset 31 with respect to the separating sections 23, 24 aligned to taper towards one another of the predetermined separating region 22 and an imaginary straight connecting line 26 between them. The offset 31 may have a value selected from a value range with a lower limit of 1.0 mm and an upper limit of 10.0 mm Preferably, the value range may have a lower limit of 2.0 mm and an upper limit of 6.0 mm.

The first separating section 23, in turn, comprises a first end 32 facing the actuating means 25, wherein the second separating section 24 comprises a second end 33 facing the actuating means 25. In the region of the imaginary connecting line 26 between the two ends 32, 33, the sleeve is formed without interruptions due to the provided lateral offset 31 of the actuating means 25. The arrangement of the two ends 32, 33 of the separating sections 23, 24 spaced apart from one another in the direction of the constructional height 21 with respect to the gripping section 27 forming the actuating means 25 is selected such that the first gripping section end 28 of the gripping section 27 overlaps the adjacent first end 32 of the first separating section 23 onto the side facing away from the second separating section 24. By the lateral offset 31 of the gripping section 27 onto the side facing away from the overlap region 16, a first predetermined separating section 34 is formed in the sleeve of the outer part 12, as seen in the circumferential direction, between the first gripping section end 28 and the first end 32 of the first separating section 23.

It is also provided that the second gripping section end 29 of the gripping section 27 overlaps the adjacent second end 33 of the second separating section 24 onto the side facing away from the first separating section 23. This, analogously to the first predetermined separating section 34, a second predetermined separating section 35 in the sleeve of the outer part 12, as seen in the circumferential direction, is formed between the second gripping section end 29 and the second end 33 of the second separating section 24. The two predetermined separating sections 34, 35 are formed between the respective gripping section end 28 or 29 and the respective end 32 or 33 due to the reduced dimension of the sleeve material. The two ends 32 and 33 of the separating sections 23, 24 are arranged closer to one another than the two gripping section ends 28 and 29 spaced apart from one another by the distance 30.

Hence, a user of the combination packaging container 1 is enabled to grip the actuating means 25 with its gripping section 27, to subsequently separate the two predetermined separating sections 34, 35 starting from the gripping section 27 up to the respective ends 32, 33 of the two separating sections 23, 24, and to subsequently separate the two separating sections 23, 24 until the complete separation of the sleeve. Hence, the outer part 12 may be easily separated from the inner container 2 and a sorted disposal may be performed. The two predetermined separating sections 34, 35 each form starting sections for the separation of the two separating sections 23, 24.

Each one of the two separating sections 23, 24 comprises multiple predetermined separating points which are arranged behind one another in a row and which are in most cases formed as perforations, in particular also as short cuts, in the material of the outer part 12.

In this exemplary embodiment, it is shown that the shape and location of the predetermined separating points with respect to one another may be selected differently. Thus, those predetermined separating points which are arranged directly adjacent to the respective gripping section ends 28, 29 are referred to as first predetermined separating points 36. The further predetermined separating points provided so as to follow in the direction of one of the two front sides 19, 20 are referred to as second predetermined separating points 37 and third predetermined separating points 38.

The predetermined separating points 36, 37, 38 are designed and arranged as mirror images of each other with respect to a plane 39 aligned centrally and in perpendicular alignment with the longitudinal axis 8—see FIG. 1. Thus, merely those predetermined separating points 36, 37, 38 located in the region of the first separating section 23 are described in further detail and are to be transferred in analogous manner to the second separating section 24.

The first predetermined separating point 36 has a first longitudinal extension 40 extending essentially in parallel direction with respect to the imaginary connecting line 26 between the two separating sections 23, 24 or extending in parallel direction with respect to one of the longitudinal edges 17, 18 on its side facing away from the gripping section 27. However, it would also be possible to align the first longitudinal extension slightly obliquely in the direction towards the actuating means 25.

Following the first longitudinal extension 40, a second longitudinal extension 41 is provided, which is located on the side facing the gripping section 27 and is oriented to project in the direction towards the gripping section 27. Due to the approximately parallel alignment of the first longitudinal extension 40, it is designed to run in a straight line. The first longitudinal extension 40 and the second longitudinal extension 41 together form the first predetermined separating point 36 and are, for example, formed by a punching process and preferably completely pass through the thickness of the blank cut 13 to form the outer part 12. The second longitudinal extension 41 of the first predetermined separating point 36 may be designed so as to be arcuately curved. However, an angles and straight formation of the second longitudinal extension 41 of the first predetermined separating point 36 in the direction towards the actuating means 25 would also be possible. In any case, the second longitudinal extension 41 of the first predetermined separating point 36 ends before reaching the gripping section 27.

The second and/or third predetermined separating points 37, 38 of the two separating sections 23, 24, which are located following the first predetermined separating points 36, may have an angular alignment with respect to the imaginary connecting line 26. The angular alignment of the second predetermined separating points 37 and/or the third predetermined separating points 38 of the first separating section 23 and the second separating section 24 may be selected such that they are each aligned to taper towards one another towards the side facing away from the actuating means 25. In this regard, the respective predetermined separating points 37, 38 which are symmetrical with respect to the perpendicular plane—plane 39—are to be considered. Preferably, the two predetermined separating points 37 may be designed to be longer than the following third predetermined separating points 38.

Moreover, it is possible that an angle 42-1, 42-2 enclosed by the second and/or third predetermined separating points 37, 38 of the first separating section 23 and by the second and/or third predetermined separating points 37, 38 of the second separating section 24 is formed starting from the actuating means 25 towards the respective front sides 19, 20 is formed differently with respect to one another. As mentioned above, the angle 42-1 between the second predetermined separating points 37 or the angle 42-2 between the third predetermined separating points 38 corresponding with one another is always to be considered. The enclosed angle 42-1, 42-2 may be designed to be increasing and thus larger starting from the actuating means 25 towards the respective front sides 19, 20. In the present exemplary embodiment, the enclosed angle 42-2 between the respective third predetermined separating points 38 is always selected equally, however, larger than the angle 42-1 enclosed by the second predetermined separating points 37.

The formation of the actuating means 25 as well as its gripping section 27 may be selected differently. In the present exemplary embodiment, the gripping section 27 is formed by a cutting line completely passing through the sleeve. Here, the cutting line has a straight longitudinal extension. Further possible embodiments of the predetermined separating region 22, in particular of its actuating means 25, will be described in further detail in the following figure descriptions.

The overlap region 16 between the two end sections 14, 15 may be selected such that the predetermined separating region 22 is arranged or formed in the first end section 14 and the first end section 14 is located on the inside and is outwardly overlapped by the second end section 15 in the overlap region 16. In this exemplary embodiment, the predetermined separating region 22 is arranged so as to extend in parallel direction with respect to the second longitudinal edge 18 of the overlapping outward second end section 15. Moreover, it may be provided that the predetermined separating region 22 is arranged or formed outside the overlap region 16.

FIG. 4 shows a further embodiment, which is possibly independent in itself, of the blank cut 13 for forming the outer part 12, wherein again, equal reference numbers/component designations are used for equal parts as before in FIGS. 1 to 3. In order to avoid unnecessary repetitions, it is pointed to/reference is made to the detailed description in FIGS. 1 to 3 above.

The general structure and the arrangement of the predetermined separating region 22 is selected analogously as already described in detail above. Thus, merely the differences existing in this regard will be addressed in further detail.

The predetermined separating region 22 of the blank cut 13 comprises the two separating sections 23 and 24 as well as the gripping section 27 located between these. The actuating means 25 further comprises an opening 43 completely passing through the sleeve in addition to the gripping section 27. The opening 43 is arranged on the side of the gripping section 27 facing away from the overlap region 16 and so as to directly adjoin the gripping section 27. Furthermore, the opening 43 ends at the cutting line of the gripping section 27. By providing the opening, gripping of the gripping section 27 can be facilitated for a user.

FIG. 5 shows a further embodiment, which is possibly independent in itself, of the blank cut 13 for forming the outer part 12, wherein again, equal reference numbers/component designations are used for equal parts as before in FIGS. 1 to 4. In order to avoid unnecessary repetitions, it is pointed to/reference is made to the detailed description in FIGS. 1 to 4 above.

The predetermined separating region 22 of the blank cut 13 comprises the two separating sections 23 and 24 as well as the gripping section 27 located between these. As opposed to the exemplary embodiments shown in FIGS. 1 to 4, here, the cutting line for forming the gripping section 27 has a curved longitudinal extension. Preferably, the longitudinal extension extends so as to be arcuately curved. In the present exemplary embodiment, the gripping section 27 has a convex longitudinal extension with a curvature facing away from the overlap region 16. Hence, a kind of actuating tab may be formed, which can further facilitate the gripping and actuation for the separation process.

Independently of this, however, a concave curvature could also be provided for forming the cutting line.

Moreover, the opening 43 described above in FIG. 4 and directly adjoining the cutting line may also be provided in the sleeve for forming the actuating means 25. The formation of the predetermined separating sections 34, 35 as well as their predetermined separating points 36, 37 and 38 may be carried out analogously, as was described above.

FIGS. 6 and 7 show a further embodiment, which is possibly independent in itself, of the blank cut 13 for forming the outer part 12, wherein again, equal reference numbers/component designations are used for equal parts as before in FIGS. 1 to 5. In order to avoid unnecessary repetitions, it is pointed to/reference is made to the detailed description in FIGS. 1 to 5 above.

The formation and arrangement of the predetermined separating region 22 in the first end section 14 of the blank cut 13 may be performed according to one of the exemplary embodiments described above. The predetermined separating region 22, in turn, comprises the separating sections 23 and 24 located on both sides of the actuating means 25.

As opposed to the exemplary embodiments described above, in which the first end section 14 with the predetermined separating region 22 located therein is overlapped by the second end section 15 in the overlap region 16, here, the first end section 14 is arranged outwardly in the overlap region 16 and thus so as to overlap the second end section 15.

Thus the predetermined separating region 22 is also, again, arranged or formed in the first end section 14, wherein the second end section 15 is arranged on the inside in the overlap region 16 and thus so as to overlap therewith.

FIG. 8 shows the combination packaging container 1 with the inner container 2 and the outer part 12 surrounding the container sleeve 4 in partially sectional view. The general structure of the inner container 2 and the outer part 12 corresponds to the one that was described above in FIGS. 1 to 7. Therefore, again, equal reference numbers and/or component designations are used again for equal parts as in FIGS. 1 to 7 preceding it. In order to avoid unnecessary repetitions, it is pointed to/reference is made to the detailed description in FIGS. 1 to 7 above. Here, the predetermined separating region 22 described above in detail with its actuating means 25 and the separating sections 23, 24 located on both sides is formed analogously as in FIGS. 1 to 7 before. To provide a better overview, many of the additional reference numbers used before were not indicated again.

In the region of the closed end 7 of the inner container 2, it comprises the shoulder 11 projecting in the radial direction, with which shoulder 11 the first front side 19 of the outer part 12 is supported, in its fitted position with the inner container 2, on the side or direction facing away from the open end 5. In the region of the open end 5 of the inner container 2, a holding arrangement 44 is provided directly adjacent to the flange 6, so as to additionally hold the outer part 12 on the inner container 2, in particular hold it so as to be fixed thereon in a form-fitted manner The partial section of the holding arrangement 44 is shown in detail "X" on the left below the combination packaging container 1 in an enlarged view.

For this purpose, the sleeve-shaped outer part 12 comprises a separate folded edge 45. The folded edge 45 is folded inwards in the direction towards the longitudinal axis 8 or in the direction towards the container sleeve (4), whereby no additional disruptive edges are arranged or formed on the outer side of the sleeve-shaped outer part 12 facing the viewer. The folded edge 45 may be provided or formed across the entire circumference or approximately across the entire circumference of the outer part 12. However, preferably it is possible to not form the folded edge 45 across the entire circumference of the outer part 12 but merely in some sections. In this regard, a multiple arrangement thereof distributed over the circumference is possible. The container sleeve 4 comprises an inwardly offset wall section 46, which forms a receiving space 47 for the folded edge 45, for receiving and supporting the folded edge 45. The receiving space 47 is preferably designed continuously across the entire circumference but may also be formed merely in some segments or in some sections. As a transition of the inwardly offset wall section 46 and the remaining container sleeve 4, a stepped surface 48 starting out from the inwardly offset wall section 46 and projecting towards a side facing away from the longitudinal axis 8 is provided. The inwardly folded folded edge 45 is supported on the stepped surface 48 with its front edge.

When the sleeve-shaped outer part 12 and the inner container 2 are joined, the folded edge 45 along with the outer part 12 is slid into the direction of the flange 6 until the folded edge 45 completely snapped into the receiving space 47 provided for this purpose in the region of the open end 5 of the inner container 2. Hence, an additional mechanical locking of the sleeve-shaped outer part 12 on the inner container 2 may be achieved. The folded edge 45 is preferably applied circumferentially in continuous contact with the sleeve or wall of the sleeve-shaped outer part 12 during crimping.

However, the holding arrangement 44 between the outer part 12 and the inner container 2 could also be formed by at least one holding lug projecting from the container sleeve 4 towards the side facing away from the longitudinal axis 8 and a recess or holding opening arranged or formed in the outer part 12. The holding lug projects into the recess or into the holding opening and hence holds the outer part 12 on the inner container 2.

So far, the outer part 12 has usually been additionally secured against unintentional separation by means of an adhesive agent at at least one adhesive location or an adhesive point on the container sleeve 4 of the inner container 2 if the support of the outer part 12 on the base side shoulder 11 is no longer sufficient due to excessive dimensional differences. Thus, in the case of waste separation, the outer part 12 must first be separated in the predetermined separating region 22 formed in it, then the adhesive location must be detached, and only then can the sorted, separate disposal be carried out.

The additional adhesive agent may be provided but is not necessarily required in the exemplary embodiment described in FIG. 9 and may thus also be entirely omitted.

FIG. 9 shows a possibility for carrying out the separation of the predetermined separating region 22 in a simplified manner according to the different exemplary embodiment described above. The combination packaging container 1 is shown in its undeformed original shape.

After removal of the content, usually a foodstuff or commodity, received in the combination packaging container 1, the outer part 12 is to be detached from the inner container 2 for proper and separate disposal by type. The material of the outer part 12 is formed by cellulose (cardboard, kraft paper or the like) and that of the inner container 2 is formed by a plastic material.

So far, the outer part 12 is to be detached from the inner container 2 by the user for proper and separate disposal by type. This is usually performed by gripping the actuating means 25 and by the subsequent separation process by radial or tangential lifting of one of the end sections 14 or 15. In this regard, the separation of the predetermined separating region 22 is performed and the outer part 12 may be removed from the inner container 2.

To perform the separation process of the predetermined separating region 22, here, deviating therefrom it is suggested to apply a pressure force -F- in the direction towards the combination packaging container 1 and to carry out an intended spatial deformation at least of the container sleeve 4 in this regard. Preferably, the pressure force -F- is applied in the direction of the longitudinal axis 8 or in an angled force alignment thereto. In this regard, the entire combination packaging container 1 is spatially deformed. By the deformation of the combination packaging container 1, the applied pressure force -F- is at least partially transferred into a separation force separating the predetermined separating region 22 along the predetermined separating points 36 and 37, the predetermined separating sections 34 and 35 and the separating sections 23 and 24.

The application of the pressure force -F- spares searching the predetermined separating region 22, gripping the actuating means 25 and the subsequent separation process.

According to the presently suggested approach, it is easiest to place the combination packaging container 1 provided for separation either with its closed end 7 or with its open end 5 of the inner container 2 on a support surface, for example formed by a solid surface, and subsequently, the pressure force -F- is applied to the end facing away from the support surface in the direction towards the support surface by the person. The support surface and/or solid surface may, for example, be the floor, the table or a countertop. The pressure force -F- may be applied directly by the person with their hand or hands or with their foot. In order to provide an indication to the person who is to apply the compressive force -F- to the combination packaging container 1 in order to separate the predetermined separating region 22, a marking or an indication of how the separation process is to be carried out may be attached or arranged, for example, on the base 3 of the inner container 2 and/or on the outer part 12. The marking on the base 3 may be attached or arranged, for example, in the region of the longitudinal axis 8 and/or on the base side outer circumference.

However, it would also be possible to provide a separate pressure device designed for this purpose, into which the combination packaging container 1 to be separated may be inserted and subsequently the pressure force -F- is mechanically applied. However, it would also be possible that the separation of the predetermined separating region 22 is performed by a pressing device or the like in the course of waste disposal and that said device applies the pressure force -F-. This is usually performed during reduction of the transport volume.

Thus, the user of the combination packaging container 1 can omit the performance of the separation process and can dispose of the complete combination packaging container 1. The separation process of the predetermined separating region 22 is carried out mechanically by a press or a squeezing device during collection and/or waste disposal.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the technical teaching provided by the present invention lies within the ability of the person skilled in the art in this technical field.

The scope of protection is determined by the claims. Nevertheless, the description and drawings are to be used for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

| List of reference numbers | |
|---|---|
| 1 | Combination packaging container |
| 2 | Inner container |
| 3 | Base |
| 4 | Container sleeve |
| 5 | Open end |
| 6 | Flange |
| 7 | Closed end |
| 8 | Longitudinal axis |
| 9 | Container height |
| 10 | Indentation |
| 11 | Shoulder |
| 12 | Outer part |
| 13 | Blank cut |
| 14 | First end section |
| 15 | Second end section |
| 16 | Overlap region |
| 17 | First longitudinal edge |
| 18 | Second longitudinal edge |
| 19 | First front side |
| 20 | Second front side |
| 21 | Constructional height |
| 22 | Predetermined separation region |
| 23 | First separating section |
| 24 | Second separating section |
| 25 | Actuating means |
| 26 | Connecting line |
| 27 | Gripping section |
| 28 | First gripping section end |
| 29 | Second gripping section end |
| 30 | Distance |
| 31 | Offset |
| 32 | First end |
| 33 | Second end |
| 34 | First predetermined separating section |
| 35 | Second predetermined separating section |
| 36 | First predetermined separating point |
| 37 | Second predetermined separating point |
| 38 | Third predetermined separating point |
| 39 | Plane |
| 40 | First longitudinal extension |
| 41 | Second longitudinal extension |
| 42 | Angle |
| 43 | Opening |
| 44 | Holding arrangement |
| 45 | Folded edge |
| 46 | Wall section |
| 47 | Receiving space |
| 48 | Stepped surface |

The invention claimed is:

1. A sleeve-shaped outer part (12) for encasing a cup-shaped inner container (2) to form a combination packaging container (1), wherein the inner container (2) comprises a container sleeve (4), which is formed, in particular so as to conically taper, from an open end (5) to a base (3) forming a closed end (7), wherein the outer part (12) is formed from a blank cut (13), said blank cut (13) is wound into a sleeve in its upright state, and, in this respect, a first end section (14) and a second end section (15) of the sleeve facing the first end section (14) are connected to each other in an overlap region (16), wherein the outer part (12) moreover has a first front side (19) and a second front side (20) and the two front sides (19, 20) are spaced apart from one another and in the upright state define a constructional height (21) of the sleeve, and, in this regard, the first front side (19) can be made to face the base (3) and the second front side (20) can be made to face the open end (5) of the inner container (2), wherein at least one predetermined separating region (22) formed in the sleeve of the outer part (12) is provided, said predetermined separating region (22) comprising a first separating section (23) and a second separating section (24) each having multiple predetermined separating points (36, 37, 38), in particular perforations or cuts, arranged behind one another, as well as an actuating means (25) located between the two front sides (19, 20) in the direction of the constructional height (21) for separating the predetermined separating region (22) along the two separating sections (23, 24) located on both sides of the actuating means (25), wherein the two separating sections (23, 24) of the predetermined separating region (22) are aligned to taper towards one another as seen in the direction of the constructional height (21) of the sleeve, wherein the actuating means (25) defines a gripping section (27) having a first gripping section end (28) and a second gripping section end (29), wherein the two gripping section ends (28, 29) are arranged at a distance (30) from one another as seen in the direction of the constructional height (21) of the sleeve, and wherein the gripping section (27) of the actuating means (25) is arranged or formed outside the overlap region (16), wherein the gripping section (27) of the actuating means (25), as seen in circumferential direction, is arranged or formed so as to be laterally spaced apart by an offset (31) with respect to the separating sections (23, 24) aligned to taper towards one another of the predetermined separating region (22) and an imaginary straight connecting line (26) between them, wherein the first gripping section end (28) of the gripping section (27) overlaps an adjacent first end (32) of the first separating section (23) onto the side facing away from the second separating section (24), wherein a first predetermined separating section (34) in the sleeve of the outer part (12), as seen in the circumferential direction of the sleeve, is formed between the first gripping section end (28) and the first end (32) of the first separating section (23), wherein the second gripping section end (29) of the gripping section (27) overlaps an adjacent second end (33) of the second separating section (24) onto the side facing away from the first separating section (23), wherein a second predetermined separating section (35) in the sleeve of the outer part (12), as seen in the circumferential direction of the sleeve, is formed between the second gripping section end (29) and the second end (33) of the second separating section (24), and wherein the two predetermined separating sections (34, 35) each form a starting section for the separation of the two separating sections (23, 24) of the predetermined separating region (22) upon actuation of the actuating means (25).

2. The outer part (12) according to claim 1, wherein the gripping section (27) of the actuating means (25) is formed by a cutting line completely passing through the sleeve.

3. The outer part (12) according to claim 2, wherein the cutting line has a straight longitudinal extension.

4. The outer part (12) according to claim 2, wherein the cutting line has a curved longitudinal extension, in particular an arcuately curved longitudinal extension.

5. The outer part (12) according to claim 1, wherein the actuating means (25) comprises an opening (43) completely passing through the sleeve, said opening (43) being arranged on the side of the gripping section (27) facing away from the overlap region (16) and so as to directly adjoin the gripping section (27).

6. The outer part (12) according to claim 1, wherein the actuating means (25) is arranged approximately centrally between the two front sides (19, 20) spaced apart from one another in the direction of the constructional height (21).

7. The outer part (12) according to claim 1, wherein first predetermined separating points (36) of the two separating sections (23, 24), which are each arranged directly adjacent to the two gripping section ends (28, 29) of the gripping section (27), in each case have a first longitudinal extension (40) extending in parallel direction with respect to the imaginary connecting line (26) between the two separating sections (23, 24) on their side facing away from the gripping section (27) and in each case have a second longitudinal extension (41) aligned in the direction towards the gripping section (27) on their side facing the gripping section (27).

8. The outer part (12) according to claim 7, wherein the second longitudinal extension (41) is designed so as to be arcuately curved and/or extends so as to be aligned at an angle with respect to the first longitudinal extension (40).

9. The outer part (12) according to claim 1, wherein second predetermined separating points (37) and/or third predetermined separating points (38) of the two separating sections (23, 24), which are in each case arranged so as to adjoin the first predetermined separating points (36) as well as on the side facing away from the actuating means (25), have an alignment extending at an angle with respect to the imaginary connecting line (26).

10. The outer part (12) according to claim 9, wherein the angularly extending alignment of the second predetermined separating points (37) and/or third predetermined separating points (38) of the first separating section (23) and the second separating section (24) is selected such that these are in each case aligned to taper towards one another towards the side facing away from the actuating means (25).

11. The outer part (12) according to claim 9, wherein an angle (42-1) enclosed by the second predetermined separating points (37) of the first and the second separating sections (23, 24) or an angle (42-2) enclosed by the third predetermined separating points (38) of the first and the second separating sections (23, 24), is formed differently with respect to one another starting out from the actuating means (25) towards the respective front sides (19, 20).

12. The outer part (12) according to claim 11, wherein the enclosed angle (42-1, 42-2) is designed to be increasing and thus larger starting from the actuating means (25) towards the respective front sides (19, 20).

13. The outer part (12) according to claim 1, wherein the predetermined separating region (22) is arranged or formed in the first end section (14) and the first end section (14) is located on the inside and is outwardly overlapped by the second end section (15) in the overlap region (16).

14. The outer part (12) according to claim 13, wherein the predetermined separating region (22) is arranged so as to extend in parallel direction with respect to the longitudinal edge (18) of the overlapping outward second end region (15).

15. The outer part (12) according to claim 1, wherein the predetermined separating region (22) is arranged or formed in the first end section (14) and the first end section (14) is arranged outwardly in the overlap region (16) and the second end section (15) is arranged inwardly and is outwardly overlapped by the first end section (14).

16. The outer part (12) according to claim 15, wherein the predetermined separating region (22) is arranged to extend in parallel direction with respect to a longitudinal edge (18) of the overlapped inward second end section (15).

17. The outer part (12) according to claim 1, wherein the predetermined separating region (22) is arranged or formed outside of the overlap region (16).

18. The outer part (12) according to claim 1, wherein the blank cut (13) is formed from a cellulose material.

19. The outer part (12) according to claim 18, wherein the cellulose material is formed from a recycling material.

20. A combination packaging container (1) comprising a cup-shaped inner container (2) having a container sleeve (4), a base (3), a flange (6) as well as a sleeve-shaped outer part (12) surrounding the inner container (2) on its container sleeve (4) at least in some sections, wherein the sleeve-shaped outer part (12) is formed according to claim 1.

21. The combination packaging container (1) according to claim 20, wherein the outer part (12) comprises, at its end section facing the flange (6), a folded edge (45) folded inwards in the direction of the container sleeve (4), and the inner container (2) has an inwardly offset wall section (46), said wall section (46) being arranged or formed directly adjacent to the flange (6) in the container sleeve (4) and defining a receiving space (47), in which receiving space (47) the folded edge (45) is received, and that the inner container (2) has a shoulder (11) on the base side, on which shoulder (11) the outer part (12) is supported.

22. A method for separating the combination packaging container (1) according to claim 20 into the inner container (2) and the outer part (12) in which the predetermined separating region (22) of the outer part (12) is at least partially separated, wherein a pressure force (-F-) directed towards the combination packaging container (1) is applied and, in the course of this, at least the container sleeve (4) of the combination packaging container (1) is spatially deformed and, by the spatial deformation, the applied pressure force (-F-) is at least partially converted into a separating force which at least partially separates the predetermined separating region (22).

23. The method according to claim 22, wherein the combination packaging container (1) is placed on a support surface either with its closed end (7) or with its open end (5) of the inner container (2) and subsequently the pressure force (-F-) is applied to the end (5, 7) facing away from the support surface in the direction towards the support surface.

24. The method according to claim 22, wherein the pressure force (-F-) is applied to the combination packaging container (1) in a parallel alignment with respect to a longitudinal axis (8) extending between the open end (5) and the closed end (7) or in an angled alignment with respect to the longitudinal axis (8).

25. The method according to claim 22, wherein the pressure force (-F-) is applied to the combination packaging container (1) by means of a pressing device.

* * * * *